United States Patent [19]

Allan

[11] Patent Number: 4,526,651

[45] Date of Patent: Jul. 2, 1985

[54] PROCESS FOR OXYGEN BLEACHING PAPER PULP USING MELAMINE AS A VISCOSITY STABILIZER

[75] Inventor: G. Graham Allan, Seattle, Wash.

[73] Assignee: Melamine Chemicals, Inc., Donaldsonville, La.

[21] Appl. No.: 654,283

[22] Filed: Sep. 24, 1984

Related U.S. Application Data

[63] Continuation-in-part of Ser. No. 537,876, Sep. 30, 1983, Pat. No. 4,487,656.

[51] Int. Cl.[3] ..... D21C 9/10

[52] U.S. Cl. ..... 162/65; 162/72

[58] Field of Search ..... 162/65, 72, 73, 76, 162/82, 83, 90, 19, 84, 86; 8/156, 111

[56] References Cited

U.S. PATENT DOCUMENTS 4,484,980 11/1984 Allan ..... 162/72
4,487,656 12/1984 Allan ..... 162/72

FOREIGN PATENT DOCUMENTS 95392 6/1982 Japan ..... 162/72
419593 11/1971 U.S.S.R. ..... 162/65

*Primary Examiner*—Steve Alvo
*Attorney, Agent, or Firm*—Mary E. Picken

[57] ABSTRACT

This invention is a process for maintaining pulp viscosity while enhancing brightness during the oxygen bleaching stage or stages of pulp preparation in the manufacture of paper comprising adding an effective amount of melamine to paper pulp prior to the oxygen bleaching stage.

4 Claims, No Drawings

PROCESS FOR OXYGEN BLEACHING PAPER PULP USING MELAMINE AS A VISCOSITY STABILIZER

This is a continuation-in-part of patent application Ser. No. 06/537,876 of 9-30-83, now U.S. Pat. No. 4,487,656.

Paper is made from wood pulp obtained from trees which undergoes a series of treatments. These treatments are described in various sources, among which the most useful is *Casey, Pulp and Paper Chemistry and Chemical Technology,* published by John Wiley and Sons, 1980. The *Kirk-Othmer Encyclopedia of Chemical Technology,* also published by John Wiley, second and third editions, is also a useful reference.

Logs are first cut into small sections and then into chips. The chips are digested to form paper pulp by a variety of processes. The pulping stage may be a thermo-mechanical, a semi-chemical, or a chemical operation. In the chemical processes, the wood chips are cooked in a closed digester tank filled with either a solution of a bisulfite sale (sulfite process), caustic soda and sodium sulfide (sulfate or kraft process) or in caustic soda solution (soda process) to dissolve the materials which hold the cellulose or paper-making fibers. After completion of the pulping process the pulp is bleached.

In one typical bleaching sequence the wood pulp is bleached with chlorine in solution (C stage), extracted with alkali (E stage) and then treated with chlorine dioxide (D stage). Another typical bleaching sequence requires: chlorination (C stage), alkali extraction (E stage) and two hypochlorite bleachings (H stage). This second sequence is written as C-E-H-H where washing between the stages is indicated by a hyphen (Casey, page 669). After bleaching, these as yet unmodified cellulose fibers next undergo a stock preparation or refining step in either a batch beater or a continuous refining procedure. The wet mass of fibers is then formed into a sheet and dried.

In the bleaching steps competing factors are balanced. The brightness of the pulp is increased while maintaining pulp viscosity at acceptable levels. During bleaching lignin removal must occur without excessive cellulose degradation.

Various additives have been used in the bleaching steps to maintain higher viscosities without interfering with lignin removal. Sulfamic acid at 1 to 5 pounds per ton of pine kraft pulp resulted in good viscosities when used in the chlorination stage (Aldrich, TAPPI, March, 1968, Volume 51, 3,71A). It is also known that the drop in viscosity during the chlorination stage can be decreased by adding chlorine dioxide (Fredericks, TAPPI, January, 1971, Volume 54, 1,87). In another study, sulfamic acid was effective in the hypochlorite stage on bamboo pulp obtained by the sulfate process (Jangalgi, IPPTA, January, 1971, Volume 8, 1,11). However, sulfamic acid, a white crystalline powder, has corrosive properties which can produce skin inflammation or blindness if permitted to enter the eye (Hernadi, Zellstoff und Papier 1975/5 p. 147–149). A need for a replacement for sulfamic acid as viscosity stabilizer in bleaching is apparent.

It has been found that melamine may be used to replace sulfamic acid as a viscosity protector in the bleaching stages. Melamine may be used in smaller amounts than sulfamic acid while achieving similar viscosity protection. In one embodiment, this invention is a process for maintaining pulp viscosity while enhancing brightness during the bleaching stages of pulp preparation in paper manufacture comprising adding an effective amount of melamine to paper pulp prior to or during the bleaching stages of paper pulp manufacture.

In another embodiment, this invention is a process for maintaining pulp viscosity while enhancing brightness during the bleaching stages of pulp preparation in paper manufacture comprising adding up to 2 parts by weight melamine to 100 parts by weight dry paper pulp.

In another embodiment this invention is a process for maintaining pulp viscosity while enhancing brightness during the bleaching stages of paper pulp manufacture comprising adding from 0.10 to 1.0 parts by weight melamine to 100 parts by weight dry paper pulp.

In a preferred embodiment, this invention is a process for maintaining pulp viscosity while enhancing brightness during the bleaching stage or stages in paper manufacture comprising adding about 0.25 parts by weight melamine to 100 parts by weight dry paper pulp.

The following examples show the use of melamine as an additive in the bleaching stages using kraft process pulp in a laboratory test (Examples 1, 2 and 3) and bamboo/mixed tropical hardwoods pulp in a mill scale evaluation (Example 4).

The melamine used was the commercially available crystal sold by Melamine Chemicals, Inc., Donaldsonville, LA.

The pulp and pulp strength properties are measured according to standard TAPPI methods (Technical Association of the Pulp and Paper Industry, Atlanta, GA.).

| | TAPPI Method |
|---|---|
| Kappa Number | T236 os-76 |
| Viscosity (Cp) | T230 os-76 |
| Laboratory Pulp Processing (PFI MILL) | T248 pm-74 |
| Freeness | T227 os-58 |
| Forming Handsheets for Physical Testing | T205 om-81 |
| Brightness | T452 os-77 |
| Physical Testing of Pulp Handsheets (caliper, burst index, tensile index, tear index, folding endurance) | T220 os-71 |

EXAMPLE 1

Melamine as a Viscosity Stabilizer in the Bleaching Stage of Pulp Preparation Unbleached kraft process pulp having a kappa number of 38.7 was treated with sulfamic acid, urea or melamine at various percentages on pulp according to the following bleaching procedure. The single capital letters, C, E, D are used to describe particular bleaching stages as described in Casey, *Pulp and Paper Chemistry and Chemical Technology,* John Wiley and Sons, 1980, Page 669. The removal of lignin during the bleaching stage is expressed as a reduction in the kappa number.

The delignification/bleachiing stages were accomplished as follows: Protective agents were added at the indicated percentages on pulp and chlorination with chlorine water (C stage) was at 9.66% chlorine on pulp at room temperature for one hour at 3% pulp consistency.

Caustic extraction with sodium hydroxide (E stage) was done at 4% NaOH on pulp at 70° C. for one hour at 12% pulp consistency. Chlorine dioxide bleaching with $ClO_2$ (D stage) was at 1.5% $ClO_2$ on pulp at 70° C. for 2.5 hours at 12% pulp consistency.

Table 1 presents the pulp properties after the C and E stage and after C, E and D stages when the various protective agents were added to kraft process pulp. About 0.25% melamine on pulp protects the viscosity after C and E stages to about the same extent that 0.50% sulfamic acid protects the viscosity.

TABLE I

EFFECT OF CELLULOSE PROTECTORS IN CHLORINE DELIGNIFICATION

| | | Pulp Properties | | | |
|---|---|---|---|---|---|
| | % | C-E Stage | | C-E-D | |
| Protective Agents | on Pulp | Kappa Number | Viscosity (Cp) | Brightness % | Viscosity (Cp) |
| None | . . . | 8.6, 9.0 | 24,5, 23.7 | 72, 71.3 | 17.1 |
| Sulfamic Acid | 0.5 | 9.5 | 35.8 | 71.3 | 23.7 |
| Urea | 1.0 | 8.2 | 33.8 | 71.0 | 22.0 |
| Melamine | 0.10 | 8.8, 9.1 | 27, 27.2 | 71.5, 72.5 | |
| | 0.15 | 9.6 | 29.9 | 72.0 | |
| | 0.20 | 8.6 | 32.8 | 73.0 | |
| | 0.26 | 9.0 | 37.7 | 70.5 | |
| | 0.30 | 10.3 | 38.0 | 71.5 | |
| | 0.50 | 10.4 | 40.0 | 71.8 | 28.6 |
| | 0.80 | 9.7 | 41.0 | 71.7 | |
| | 1.20 | 9.7 | 41.6 | 71.8 | |
| | 1.43 | 9.7, 9.4 | 41.6, 42, 41.2 | 72, 71.5 | 29.2 |

EXAMPLE 2

Melamine as a Viscosity Stabilizer When Used at Various Temperatures in the Chlorination Stage.

Unbleached kraft process spruce pulp having a kappa number of 38.7 was bleached in C-E-D sequences with and without the use of melamine and sulfamic acid in the chlorination stage at different temperatures. Table II contains a summary of the comparative pulp properties after C-E stages and Table III summarizes the comparative properties after C-E-D stages. It can be seen from these figures that melamine at a reduced level (0.25%) is as effective as sulfamic acid (0.5%) even at higher temperatures of chlorination.

TABLE II

Effect of Melamine at Different Temperatures of Chlorination (pulp properties after C-E stages).

| | PROTECTIVE AGENT | | |
|---|---|---|---|
| Properties | None (Control) | Sulfamic Acid (0.5% on Pulp) | Melamine (0.25% on Pulp) |
| Temp. 30° C. | | | |
| Kappa Number | 8.5 | 7.7 | 7.5 |
| Viscosity (Cp) | 23.8 | 36.7 | 34.7 |
| Temp: 40° C. | | | |
| Kappa Number | 8.2 | 8.7 | 6.2 |
| Viscosity (Cp) | 23.2 | 34.2 | 34.0 |
| Temp: 50° C. | | | |
| Kappa Number | 8.6 | 7.7 | 6.5 |
| Viscosity (Cp) | 22.2 | 32.5 | 32.8 |

Conclusions: At all temperatures the Kappa Number achieved is lowest with melamine. Viscosity values obtained with melamine are comparable to those achieved by using a higher % of sulfamic acid.

TABLE III

Effect of Melamine at Different Temperatures of Chlorination (pulp properties after C-E-D stages).

| | PROTECTIVE AGENT | | |
|---|---|---|---|
| Properties | None (Control) | Sulfamic Acid (0.5% on Pulp) | Melamine (0.25% on Pulp) |
| Temp: 30° C. | | | |
| Kappa Number | 3.2 | 2.5 | 1.8 |
| Viscosity Cp | 17.5 | 24.5 | 24.0 |
| Brightness % | 71.0 | 70.5 | 71.0 |
| Temp: 40° C. | | | |
| Kappa Number | 3.1 | 2.8 | 2.2 |
| Viscosity Cp | 16.8 | 23.7 | 23.5 |
| Brightness % | 70.5 | 71.0 | 70.5 |
| Temp: 50° C. | | | |
| Kappa Number | 2.3 | 3.2 | 2.5 |
| Viscosity Cp | 16.3 | 21.3 | 21.5 |
| Brightness % | 70.0 | 70.0 | 70.5 |

At each temperature level the effect of melamine on viscosity is comparable to that of sulfamic acid but with a lower dosage level (0.25% melamine against 0.5% sulfamic acid).

EXAMPLE 3

Melamine as a Viscosity Stabilizer in the Hypochlorite Bleaching Stage of Pulp Preparation Unbleached kraft process spruce pulp having a Kappa number of 38.7 was bleached in a C-E-H sequence with the use of sulfamic acid (0.5%) or melamine (0.25%) in the hypochlorite stage (H. stage) in two separate experiments. A third experiment was done without any additive as a control. The comparative results reported in Table IV show the effect of melamine as a viscosity stabilizer in the hypochlorite stage of bleaching.

TABLE IV

Effect of Melamine in the Hypochlorite Stage

| Protective Agents Used in Chlorination/Hypochlorite Stage | Properties After C-E Stages | | Properties After C-E-H Stages | | |
|---|---|---|---|---|---|
| | Kappa Number | Viscosity (Cp) | Kappa Number | Viscosity (Cp) | Brightness % |
| None/None (Control) | 6.0 | 18.3 | 1.7 | 7.5 | 75.3 |
| None/ Sulfamic Acid (0.5%) | " | " | 1.3 | 9.4 | 76.5 |
| None/ Melamine (0.25%) | " | " | 1.5 | 9.2 | 75.1 |

Results indicate comparable viscosities for melamine in comparison with those obtained for sulfamic acid at higher dosage levels.

EXAMPLE 4

Mill Trial. Melamine as a Viscosity Stabilizer in the Bleaching Stage of Pulp Preparation A mixture of bamboo and mixed tropical hardwoods kraft pulp was fed to a continuous bleach plant operating with C-E-H-H bleaching sequence at the rate of 35–40 kg per hour. The chlorination (C. Stage) reaction time was 1.5 hours at 25° C. After alkali extraction (E. stage retention time: 1.25 hours) hypochlorite bleaching using calcium hypochlorite (H. Stage) required 2 hours in each of the two stages. Melamine was used in two independent trials—(1) in the chlorination stage and (2) in the first hypochlorite stage. Where the melamine additive was used, it was at the rate of 0.25% relative to the rate of feed of unbleached pulp.

Tables V and VI provide a comparison of control values with the values obtained with the chlorine stage use of melamine. Table V reports the effect on pulp properties of chlorine stage addition of melamine. The effect on pulp strength properties of chlorine stage addition of melamine is summarized in Table VI.

Table VII and VIII provide a comparison of control values with the values obtained with the use of malamine additive in the first hypochlorite bleaching stage. While Table VII reports the effect on basic pulp properties, Table VIII summarizes the effect on pulp strength properties of the melamine addition.

TABLE V

The Effect on Pulp Properties of Chlorine Stage Addition of Melamine.

| Pulp Properties | Without Melamine | With Melamine |
|---|---|---|
| Unbleached pulp | | |
| Kappa Number | 23.7[1] | 26.5[1] |
| Viscosity, Cp | 19.0[1] | 16.2[1] |
| C-E pulp | | |
| Kappa Number | 8.8 ± 1.5[2] | 6.7 ± 0.6[2] |
| Viscosity, Cp | 12.8 ± 1.0[3] | 12.8 ± 0.4[3] |
| Hypo-I pulp | | |
| Brightness % | 75–77 | 76–77 |
| Viscosity, Cp | 6.9 ± 0.2 | 7.5 ± 1.4 |
| Post color number (16 h) | 6.58 ± 0.32 | 6.38 ± 0.46 |
| Plant conditions | | |
| Chlorine tower overflow pulp | | |
| pH | 2.4–2.8 | 2.2–2.7 |
| Temperature °C. | 27/28 | 28/29 |
| Residual chlorine, gpL | .021 ± 0.14[4] | .115 ± .058[4] |
| Alkali extraction pulp | | |
| pH | 10.8–11.8 | 11.0–11.3 |
| Alkali tower temperature °C. | 59/42 (top) (bottom) | 59/41 (top) (bottom) |
| Hypo-I stage overflow pulp | | |
| pH | 7.7–9.4 | 7.4–8.9 |
| Hypo-I tower temperature °C. | 42 ± 1 | 42 ± 2 |

[1]Differences are due to variations in incoming pulp.
[2]Kappa Number with additive is lower even when Kappa Number of feed is higher.
[3]Viscosities are identical even when viscosity of control pulp is initially higher.
[4]Implies that less chlorine is needed to achieve same level of delignification.

TABLE VI

The Effect on Pulp Strength Properties of Chlorine Stage Addition of Melamine.

| Pulp Strength Properties | Without Melamine | | With Melamine | | 95% Confidence |
|---|---|---|---|---|---|
| Freeness, mL | 500 | 300 | 500 | 300 | Limits |
| Unbleached pulp | | | | | |
| Tensile index, Nm/g | 57.9 | 68.3 | 60.9 | 67.8 | ±2.2 |
| Burst index, kPam²/g | 4.05 | 5.03 | 4.52* | 4.84 | .20 |
| Tear index, mNm²/g | 14.1 | 12.3 | 13.3 | 11.8 | 1.2 |
| Folding endurance[2] | 302 | 851 | 479 | 832 | 23% |
| C-E pulp | | | | | |
| Tensile index, Nm/g | 50.0 | 67.1 | 60.0* | 67.2 | 2.7 |
| Burst index, kPam²/g | 3.45 | 4.92 | 4.55* | 5.17* | .19 |
| Tear index, mNm²/g | 11.0 | 10.7 | 13.1 | 11.3 | 1.2 |
| Folding endurance[2] | 120 | 724 | 398* | 795 | 16% |
| C-E-H pulp | | | | | |
| Tensile index, Nm/g | 46.6 | 64.2 | 55.6* | 63.6 | 2.2 |

TABLE VI-continued

The Effect on Pulp Strength Properties of Chlorine Stage Addition of Melamine.

| Pulp Strength Properties | Without Melamine | | With Melamine | | 95% Confidence |
|---|---|---|---|---|---|
| Freeness, mL | 500 | 300 | 500 | 300 | Limits |
| Burst index, kPam²/g | 3.68 | 3.78 | 4.33* | 5.20* | .17 |
| Tear index, mNm²/g | 9.74 | 9.50 | 11.8 | 11.7 | 1.5 |
| Folding endurance[2] | 72 | 537 | 209* | 692 | 16% |

[1]Handsheets were conditioned at 50% RH and 73° F.
[2]Folding endurance is the number of folds measured using a MIT tester set at 0.5 kg tension
*Indicates statistical significance at the 95% confidence level.

TABLE VII

The Effect on Pulp Properties of Hypochlorite Stage Addition of Melamine.

| Pulp Properties | Without Melamine | With Melamine |
|---|---|---|
| C-E pulp | | |
| Kappa Number | 8.7 | 8.2 |
| Viscosity, Cp | 12.3 | 11.8 |
| Hypo-I pulp | | |
| Brightness % | 76–77 | 74–77 |
| Viscosity, Cp | 7.0 ± 1.3[1] | 9.6 ± 0.4[1] |
| Post color number (16 h) | 6.52 ± 1.23 | — |
| Hypo-II pulp | | |
| Brightness, % | 78–80 | 78–81 |
| Viscosity, Cp | 6.2 ± 0.8 | 6.6 ± 0.3 |
| Post color number (16 h) | 6.64 ± 1.25 | — |
| Plant conditions | | |
| Alkali extraction pulp | | |
| pH | 9.5–10.8 | 9.8–10.3 |
| Alkali tower temperature °C. | 58/44 (top) (bottom) | 57/42 (top) (bottom) |
| Hypo-I stage overflow pulp | | |
| pH | 6.8–8.2 | 7.6–9.0 |
| Hypo-I tower temperature °C. | 42–43 | 40–42 |
| Residual chlorine, gpL | .001 ± .004[2] | .167 ± .030[2] |
| Hypo-II stage overflow pulp | | |
| pH | 7.6–8.2 | 8.4–8.6 |
| Hypo-II tower temperature °C. | — | — |
| Residual chlorine, gpL | trace | .006 ± 001 |

[1]Demonstrates improvement in pulp viscosity due to melamine
[2]Implies that less chlorine is used up to achieve same level of brightness.

TABLE VIII

The Effect on Pulp Strength Properties of Hypochlorite Stage Addition of Melamine

| Pulp Strength Properties | Without melamine | | With Melamine | | 95% Confidence |
|---|---|---|---|---|---|
| Freeness, mL | 500 | 300 | 500 | 300 | Limits |
| C-E pulp | | | | | |
| Tensile Index, Nm/g | 64.8 | 67.2 | 61.0 | 69.7 | ±2.4 |
| Burst Index, kPam²/g | 4.73 | 5.38 | 4.95 | 5.65 | .18 |
| Tear Index, mNm²/g | 12.0 | 10.5 | 12.1 | 7.40* | 1.1 |
| Folding endurance[2] | 302 | 1047 | 597 | 1148 | 22% |
| C-E-H pulp | | | | | |
| Tensile Index, Nm/g | 51.3 | 61.5 | 58.7* | 67.2* | 2.4 |
| Burst Index, kPam²/g | 3.20 | 3.83 | 4.0* | 5.25* | .14 |
| Tear Index, mNm²/g | 8.13 | 7.45 | 11.0* | 10.5* | 1.3 |

TABLE VIII-continued

| Pulp Strength Properties | The Effect on Pulp Strength Properties of Hypochlorite Stage Addition of Melamine: Without melamine | | With Melamine | | 95% Confidence Limits |
|---|---|---|---|---|---|
| Freeness, mL | 500 | 300 | 500 | 300 | |
| Folding endurance[2] | 59 | 251 | 269* | 759* | 23% |
| C-E-H-H pulp | | | | | |
| Tensile Index, Nm/g | 46.3 | 57.9 | 54.4* | 66.2* | 3.0 |
| Burst Index, $kPam^2/g$ | 2.70 | 3.53 | 3.63* | 5.00* | .18 |
| Tear Index, $mNm^2/g$ | 8.35 | 7.40 | 8.85 | 9.75* | 1.0 |
| Folding endurance[2] | 35 | 138 | 100* | 550* | 19% |

[1]Handsheets were conditioned at 50% RH and 73° F.
[2]Folding endurance is the number of folds measured using a MIT tester set at 0.5 kg tension.
*Indicates statistical significance at the 95% confidence level.

Without wishing to be bound by theory it is currently thought that the flat molecular structure of melamine together with its facility for forming hydrogen bonds with cellulose are the main factors responsible for its surprising and unexpected performance as a viscosity stabilizer. The covering of the cellulose by the flat melamine molecules may act like armor plate, helping to keep the bleach away from direct contact with the cellulose.

In one preferred embodiment this invention is a process for maintaining pulp viscosity while enhancing brightness during the bleaching stage of pulp preparation in paper manufacture comprising: adding an effective amount of melamine to paper pulp prior to the oxygen bleaching stage of paper pulp manufacture.

Example 5 shows the use of melamine as an additive prior to the oxygen bleaching stage using unbleached kraft process pulp in a laboratory test.

EXAMPLE 5

Melamine as a Viscosity Stabilizer and Brightness Enhancer in Oxygen Bleaching Three different unbleached kraft process pulps having kappa numbers of 37.1 (Trial #1), 24.1 (Trial #2) and 22.7 (Trial #3) were pretreated by stirring for 20 minutes at 70° C. in a solution of $H_2SO_4$ and melamine, (when used the melamine was at 2% on pulp). After pretreating the pulp was centrifuged and resuspended in 1500 mL so that the consistency was 2%.

Samples of pretreated pulp and untreated pulp were bleached using oxygen at 100 pounds per square inch pressure, at 20° C. for one hour at 4% NaOH concentration. Measurements of pulp characteristics after oxygen bleaching were made according to these TAPPI methods:

| | TAPPI Method |
|---|---|
| Kappa Number | T 236 os-76 |
| Viscosity | T 230 os-76 |
| Brightness | T 452 os-77 |

Table 9 summarizes the measurements after one hour oxygen bleaching.

TABLE IX

| The Effect on Some Pulp Properties of the Addition of Melamine During Oxygen Bleaching | | Trial #1 | Trial #2 | Trial #3 |
|---|---|---|---|---|
| Kappa Number | untreated control pulp | 12.4 | 8.2 | 7.7 |
| | melamine pre-treated pulp | 10.3 | 6.0 | 6.9 |
| Viscosity | untreated control pulp | 14.0 | 8.0 | 9.9 |
| | melamine pre-treated pulp | 14.2 | 9.2 | 10.8 |
| Brightness | untreated control pulp | 37.3 | 37.6 | 39.1 |
| | melamine pre-treated pulp | 39.7 | 40.8 | 42.4 |

The viscosity levels were about the same after one hour of oxygen bleaching in the trials comparing melamine pre-treated pulps with untreated control pulps. The kappa number decreased in each test of pulps pretreated with melamine while the brightness increased in each of those tests.

A further measurement of the rate of brightness improvement was made by taking samples at different time intervals. Table X presents the results.

TABLE X

| The Effect on Pulp Brightness of the Addition of Melamine during Oxygen Bleaching | | Time:Minutes 15 | 30 | 60 |
|---|---|---|---|---|
| Brightness | untreated control pulp | 29.4 | 33.2 | 39.1 |
| | melamine pre-treated pulp | 32.4 | 36.2 | 42.4 |

The brightness increase when the oxygen-bleached pulp has been pre-treated with melamine is observed within the first 15 minutes of bleaching. Pulps attaining early brightness increases will require smaller amounts of treating chemicals when these pulps are subjected to conventional bleaching sequences using chlorination subsequent to the oxygen stage.

Laboratory tests show no improvement in pulp properties when melamine, instead of being used as a pretreatment, is used by direct addition to the caustic bleach solution.

I claim:

1. A process for maintaining pulp viscosity while enhancing brightness during the bleaching stages of pulp preparation in paper manufacture comprising: adding an effective amount of melamine to paper pulp prior to an oxygen bleaching stage of paper pulp manufacture, wherein the melamine is added in an amount effective to maintain the pulp viscosity while enhancing the brightness during said oxygen bleach stage.

2. The process of claim 1 wherein up to 2 parts by weight melamine are added to 100 parts by weight dry pulp.

3. The process of claim 2 wherein from 0.1 parts to 2.0 parts by weight by weight melamine are added to 100 parts by weight dry paper pulp.

4. The process of claim 1 wherein said paper pulp is formed by digestion in a chemical process selected from the group consisting of the sulfate process, the sulfite process and the soda process prior to said oxygen bleaching stage.

* * * * *